US011492830B2

(12) United States Patent
Orlando et al.

(10) Patent No.: US 11,492,830 B2
(45) Date of Patent: Nov. 8, 2022

(54) GATE HINGE AND ASSOCIATED METHODS

(71) Applicants: Kevin Orlando, Merritt Island, FL (US); Todd Paroline, Melbourne, FL (US)

(72) Inventors: Kevin Orlando, Merritt Island, FL (US); Todd Paroline, Melbourne, FL (US)

( * ) Notice: Subject to any disclaimer, the term of this patent is extended or adjusted under 35 U.S.C. 154(b) by 0 days.

(21) Appl. No.: 17/352,552

(22) Filed: Jun. 21, 2021

(65) Prior Publication Data

US 2021/0310288 A1 Oct. 7, 2021

Related U.S. Application Data

(60) Provisional application No. 63/042,279, filed on Jun. 22, 2020.

(51) Int. Cl.
*E05D 7/04* (2006.01)
*E05D 7/06* (2006.01)
(Continued)

(52) U.S. Cl.
CPC ..... *E05D 7/06* (2013.01); *E05D 3/02* (2013.01); *E05D 7/04* (2013.01); *E06B 11/022* (2013.01);
(Continued)

(58) Field of Classification Search
CPC ..... Y10T 16/5321; Y10T 16/5322; Y10T 16/5323; Y10T 16/53235; Y10T 16/31; Y10T 16/33; E05D 7/06; E05D 7/04; E05D 7/0423; E05D 3/02; E05D 2007/0461; E05D 2007/0484; E05D 2007/0438;
(Continued)

(56) References Cited

U.S. PATENT DOCUMENTS 1,123,913 A * 1/1915 Mueller ..... E05D 7/0054 16/239
1,423,321 A * 7/1922 Hacker ..... E05D 7/04 16/248
(Continued)

FOREIGN PATENT DOCUMENTS

FR 2455157 A * 12/1980 ..... E05D 7/04
FR 3020088 A1 * 10/2015 ..... E05D 7/06
WO WO-9204520 A * 3/1992 ..... E05D 7/043

*Primary Examiner* — Chuck Y Mah
(74) *Attorney, Agent, or Firm* — Bullock Law; Stephen Bullock

(57) ABSTRACT

Embodiments of the present invention are related to an improved gate hinge with a post assembly including an L-Bracket, a post assembly extension, and a swing axis bolt with a T-Joint. A gate assembly includes an L-Bracket and gate assembly extension. The post assembly and gate assembly are connected via connecting bolt. The swing axis bolt is oriented vertically on the post assembly extension and the connecting bolt is oriented horizontally on the gate assembly extension. The connecting bolt connects the gate assembly to the post assembly at the T-Joint. The gate assembly extension rotates via the T-Joint on the swing axis bolt. The post assembly extension distally extends a bottom portion of a gate attached to the gate assembly relative to a top portion of the gate. The distal extension creates an elevated angle between the gate bottom and ground when the improved gate hinge is actuated.

20 Claims, 9 Drawing Sheets

(51) Int. Cl.
*E05D 3/02* (2006.01)
*E06B 11/02* (2006.01)

(52) U.S. Cl.
CPC ... *E05D 2007/0461* (2013.01); *E05Y 2900/40* (2013.01)

(58) Field of Classification Search
CPC ..... E05D 2007/0446; E06B 11/022; E06B 11/02; E06B 11/04; E05Y 2900/40; E05Y 2900/402
See application file for complete search history.

(56) References Cited

U.S. PATENT DOCUMENTS 1,439,542 A * 12/1922 Fritgen ..... E05F 1/068 16/311
2,006,267 A * 6/1935 Foltz ..... E05D 7/0027 16/248
4,729,149 A * 3/1988 Brunkan ..... E05D 7/081 16/253
5,592,717 A * 1/1997 Longo ..... E05F 1/068 49/245
D396,626 S * 8/1998 Francom ..... D8/323
6,935,000 B1 * 8/2005 Arnaud ..... E05F 15/63 16/DIG. 7
D624,388 S * 9/2010 Eland ..... D8/323
7,895,713 B2 * 3/2011 Williams, Jr. ..... E05D 5/06 16/389
8,375,517 B1 * 2/2013 Johnsen ..... E05D 7/0027 16/244
D727,133 S * 4/2015 Knudson ..... D8/323
9,518,424 B1 * 12/2016 Woodard ..... E05D 15/066
10,329,819 B1 * 6/2019 Weldon ..... E05D 3/06
D924,667 S * 7/2021 Parks ..... D8/354
2005/0120517 A1 * 6/2005 Bonham ..... E05D 3/10 16/238
2005/0183238 A1 * 8/2005 McCue ..... E05D 7/0027 16/236

* cited by examiner

GATE HINGE AND ASSOCIATED METHODS

RELATED APPLICATIONS

This application claims the benefit under 35 U.S.C. § 119(e) of U.S. Provisional Patent Application Ser. No. 63/042,279 titled Improved Gate Hinge and Associated Methods filed on Jun. 22, 2020, the entire contents of which are incorporated herein by reference.

FIELD OF THE INVENTION

The present invention relates to systems and methods for improving the rotation and componentry of barrier gates. In particular, the present invention relates to an improved gate hinge and associated methods.

BACKGROUND

Traditional fence gate hinges allow for the gate to swing along a linear plane. Swinging along a linear plane does not take into account gates positioned on an incline. More often than not, opening gates equipped with traditional hinges positioned on an incline result in the bottom of the gate lodging against the incline when opened. Furthermore, opening and closing a gate equipped with traditional hinges requires a user to manually push or pull the gate for each action. Some gates may automate the opening and closing aspect. However, automated gates require electric motors, gears and a multitude of additional components that make installation difficult, increase gate maintenance, increase the likelihood for repair, and increase costs.

There exists a need in the art for an improved gate hinge that allows for the bottom of a gate to accommodate an incline when opened. Furthermore, there exists a need for a gate hinge that applies physics to automate closing the gate rather than motorized componentry. Therefore, there exists a need in the art for an improved gate hinge and associated methods.

This background is provided to reveal information believed by the applicant to be of possible relevance to the present invention. No admission is made as to prior art and nothing within the background should be construed as prior art against the present invention.

SUMMARY OF THE INVENTION

Embodiments of the present invention are related to an improved gate hinge that may include a post assembly with an L-Bracket, a post assembly extension, and a swing axis bolt with a T-Joint. A gate assembly may include an L-Bracket and gate assembly extension. The post assembly and gate assembly may be connected via connecting bolt. The swing axis bolt may be oriented vertically through a top and bottom of the post assembly extension and the connecting bolt may be oriented horizontally through a first side and a second side of the gate assembly extension. The connecting bolt may be structured to connect the gate assembly to the post assembly at the T-Joint. The gate assembly extension may be structured to rotate underneath the post assembly extension when the improved gate hinge is actuated.

In this embodiment, the post assembly extension may be structured to distally extend a bottom portion of a gate attached to the gate assembly relative to a top portion of the gate. The distal extension may be structured to create an elevated angle between the gate bottom and ground when the improved gate hinge is actuated.

This embodiment may further include a first distancing nut on a first side of the gate assembly extension and a second distancing nut on a second side of the gate assembly extension structured to be adjustable along the connecting bolt to increase or decrease a connection gap between the gate assembly and the post assembly. Additionally, the swing axis bolt may be positioned on the post assembly extension proximate an end distal the L-Bracket. In all embodiments, the post assembly and the gate assembly may be structured to attach to a bottom portion of a fence post and gate respectively.

Some embodiments may include the gate assembly rotated via the T-Joint on the swing axis bolt. Additionally, the post assembly extension and the gate assembly extension may include a plurality of positioning holes to adjust the distal extension of the swing axis bolt and the connecting bolt. A plurality of positioning holes may be located on the top and bottom of the post assembly extension and a plurality of positioning holes may be located on a first side and second side of the gate assembly.

Another embodiment may be an improved gate hinge with a post assembly including an L-Bracket, a post assembly extension, and a swing axis bolt with a T-Joint. A gate assembly may include an L-Bracket and gate assembly extension. The post assembly and gate assembly may be connected via connecting bolt and the swing axis bolt may be oriented vertically on the post assembly extension. The connecting bolt may be oriented horizontally on the gate assembly extension. The connecting bolt may connect the gate assembly to the post assembly at the T-Joint. The gate assembly extension may rotate via the T-Joint on the swing axis bolt and the post assembly extension may distally extend a bottom portion of a gate attached to the gate assembly relative to a top portion of the gate. The distal extension may create an elevated angle between the gate bottom and ground when the improved gate hinge is actuated.

In this embodiment, the post assembly extension and the gate assembly extension may include extension rails forming a post extension track and gate extension track between their respective rails. The post assembly extension rails may be positioned on the post assembly L-Bracket in a non-linear configuration with respect to the positioning of the gate assembly extension rails on the gate assembly L-Bracket creating an asymmetric offset. The asymmetric offset may be structured to create a flush mount for the post assembly and gate assembly. Furthermore, at least a portion of the swing axis bolt may be positioned within the post assembly extension track and at least a portion of the connecting bolt may be positioned within the gate assembly extension track.

This embodiment may include a post extension casing and a gate extension casing structured as slidable sleeves. The post extension casing may be structured to adjust the distance between the post assembly L-Bracket and the swing axis bolt. The gate extension casing may be structured to adjust the distance between the gate assembly L-Bracket and the connecting bolt. Furthermore, the T-Joint may be located atop the post extension casing and the connecting bolt may be connected to a side portion of the gate extension casing within the asymmetric offset between the post assembly extension rails and the gate assembly extension rails.

The post assembly extension rails may be parallel stacked to create a horizontal track therebetween. The gate assembly extension rails may be side-by-side from left to right to create a vertical track therebetween. Additionally, the post extension casing and the gate extension casing may be slidable to adjust the distal extension. An increased distal extension may be structured to create an increased elevated bottom gate angle. Furthermore, in some embodiments, the post assembly extension and the gate assembly extension may include a plurality of positioning holes structured to adjust the distal extension of the swing axis bolt and the connecting bolt. A plurality of positioning holes may be located on the top and bottom of the post assembly extension and a plurality of positioning holes may be located on a first side and second side of the gate assembly.

Another embodiment may be an improved gate hinge with a post assembly including an L-Bracket, a post assembly extension, and a swing axis bolt with a T-Joint. A gate assembly may include an L-Bracket and gate assembly extension. The post assembly and gate assembly may be connected via connecting bolt and the swing axis bolt may be oriented vertically on the post assembly extension. The connecting bolt may be oriented horizontally on the gate assembly extension and may connect the gate assembly to the post assembly at the T-Joint. The gate assembly extension may be structured to rotate via the T-Joint on the swing axis bolt.

In this embodiment the post assembly extension and the gate assembly extension may include at least one of the following configurations structured to adjust the distal extension of the swing axis bolt and the connecting bolt. They may include slidable extension casings and extension tracks and they may include a plurality of positioning holes.

Like the other embodiments, the post assembly and the gate assembly may be structured to attach to a bottom portion of a fence post and gate respectively and the post assembly extension may be structured to distally extend a bottom portion of a gate attached to the gate assembly relative to a top portion of the gate. The distal extension may be structured to create an elevated angle between the gate bottom and ground when the improved gate hinge is actuated.

DETAILED DESCRIPTION OF THE INVENTION

The present invention will now be described in detail with reference to the accompanying drawings. The embodiment descriptions are illustrative and not intended to be limiting in any way. Other embodiments of the invention will readily suggest themselves to persons with ordinary skill in the art after having the benefit of this disclosure. Accordingly, the following embodiments are set forth without any loss of generality and without imposing limitation upon the claimed invention.

Directional terms such as "above" "below" "upper" "lower" and other like terms are used for the convenience of the reader in reference to the drawings. Additionally, the description may contain terminology to convey position, orientation, and direction without departing from the principles of the present invention. Such positional language should be taken in context of the represented drawings.

Quantitative terms such as "generally" "substantially" "mostly" and other like terms are used to mean that the referred object, characteristic, or quality constitutes a majority of the referenced subject. Likewise, use of the terms such as first and second do not necessarily designate a limitation of quantity. Such terms may be used as a method of describing the presence of at least one of the referenced elements or may provide a means of differentiating orientation. The meaning of any term within this description is dependent upon the context within which it is used, and the meaning may be expressly modified.

Figure 1:
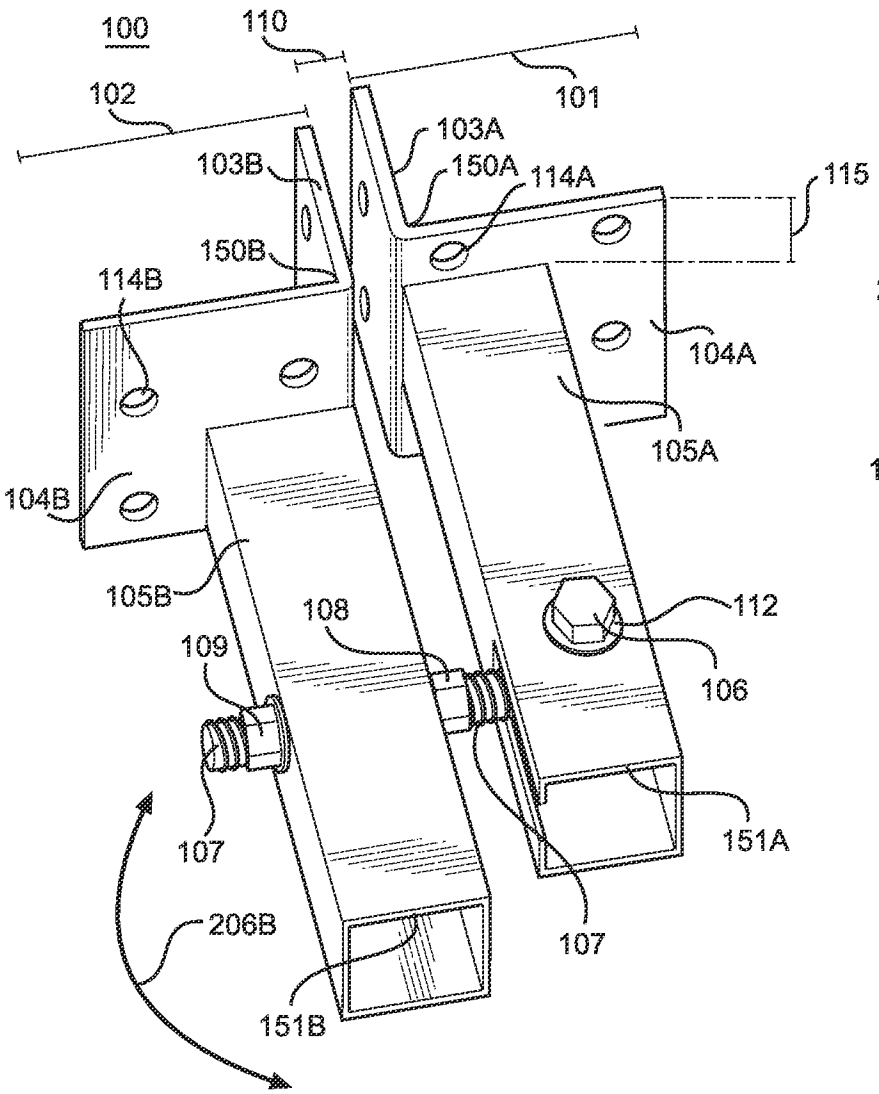
FIG. 1 is a top perspective view of the improved gate hinge according to an embodiment of the invention.

Referring now to FIG. 1, an improved gate hinge 100, hereinafter referred to as the hinge 100, will be described in more detail. The hinge 100 may include a post assembly 101 and a gate assembly 102.

The post assembly 101 may include an L-Bracket 150*a* with a first post attachment member 103*a* and a second post attachment member 104*a*. The L-Bracket 150*a* may secure to a post via securing members such as screws through post assembly apertures 114*a* within the L-Bracket 150*a*. The first post attachment member 103*a* may attach to a side of a post, while the second post attachment member 104*a* may attach to an inside portion of a post. For purposes of this application, the term post shall not be construed as limiting. More particularly, post is used to mean an upright rigid structure. By way of non-limiting example, an upright rigid structure may be a fence post, a column, a wall, and the like.

A post assembly extension 105*a* may extend distally from the second post attachment member 104*a* on a surface facing away from the first post attachment member 103*a*. As oriented in FIG. 1, the post assembly extension 105*a* may extend from the bottom surface of the second post attachment member 104*a*. The positioning of the post assembly extension 105*a* on the second post attachment member 104*a* may cause for an extension offset 115.

Passing through the post assembly extension 105*a*, proximate the end distal the second post attachment member 104*a*, may be a swing axis bolt 106 with swing axis washer 112. As oriented in FIG. 1, the swing axis bolt 106 may descend through the post assembly extension 105 and join with a connecting bolt 107 within a medial cavity 151*a* of the post assembly extension 105*a*. The connecting bolt 107 may connect the post assembly 101 to the gate assembly 102.

Like the post assembly 101, the gate assembly 102 may include an L-Bracket 150*b* with a first gate attachment member 103*b* and a second gate attachment member 104*b*. This L-Bracket 150*b* may secure to a gate via securing members such as screws through gate assembly apertures 114*b* within the L-Bracket 150*b*. The first gate attachment member 103*b* may attach to a side portion of a gate, while the second gate attachment member 104*b* may attach to an inside portion of a gate.

A gate assembly extension 105*b* may extend distally from the second gate attachment member 104*b* on a surface facing away from the first gate attachment member 103*b*. As oriented in FIG. 1, the gate assembly extension 105 may extend from the bottom surface of the second gate attachment member 104*b*. The positioning of the gate assembly extension 105 on the second gate attachment member 104*b* may cause for an extension offset 115.

Passing through the gate assembly extension 105*b*, proximate the end distal the second gate attachment member 104*b*, may be the connecting bolt 107 with a first distancing nut 108 and a second distancing nut 109 on opposing sides of the gate assembly extension 105*b*. As oriented in FIG. 1, the connecting bolt 107 may horizontally cross through a gate extension medial cavity 151*b* within the gate assembly extension 105 and join with the swing axis bolt 106.

The first distancing nut 108 and the second distancing nut 109 may be adjusted along the connecting bolt 107 to increase or decrease a connection gap 110 between the gate assembly 102 and the post assembly 101. Furthermore, as shown, the gate assembly 102 may rotate with a gate swing motion 206*b* along the indicated path utilizing the swing axis bolt 106 as its axis point.

Figure 2:
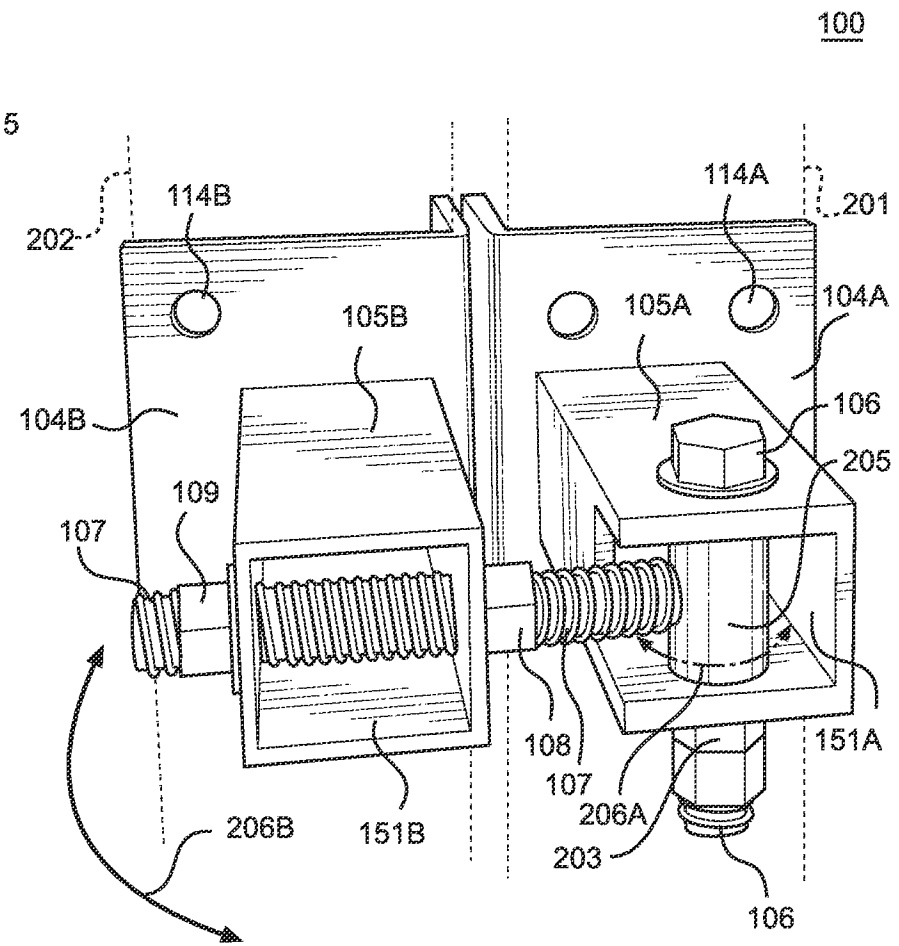
FIG. 2 is a front perspective view of the improved gate hinge illustrated in FIG. 1.

FIG. 2 provides a more in-depth view of the componentry of the post assembly 101 and the gate assembly 102 as well as illustrates how each may be oriented and attached to its respective post 201 and gate 202.

This perspective shows the hinge 100 as would be viewed from inside an enclosed area. As shown, the second post attachment member 104*a* and the second gate attachment member 104*b* are fitted onto respective interiors of the post 201 and gate 202. Simultaneously, the first post attachment member 103*a* and second gate attachment member 103*b* are abutting each other along respective sides of the post 201 and gate 202. Each may be secured via their respective apertures 114*a*, 114*b*.

The swing axis bolt 106 may descend from an upper portion of the post assembly extension 105*a* through the post extension medial cavity 151*a* and be secured by at least one swing axis nut 203 at a bottom surface of the post assembly extension 105*a*.

Within the post extension medial cavity 151*a* may be a T-Joint 205. The T-Joint may be a rotational connector with an upper, a lower, and a medial aperture connecting point. The swing axis bolt 106 may pass through an upper aperture connecting point and exit a lower aperture connecting point. The connecting bolt 107 may connect to the T-Joint 205 at its medial aperture connecting point. By way of non-limiting example, the connecting bolt 107 may be connected to the T-Joint 205 via threading. However, the T-Joint 205 may have a swing axis motion 206*a* whereby it may rotate around the swing axis bolt 106. In some embodiments the swing axis bolt 106 may rotate as well. In any embodiment, the swing axis motion 206*a* may rotate the connecting bolt 107, which in turn may rotate the gate assembly 102 and therefore the gate 202 along the gate swing motion 206*b*.

Figure 3:
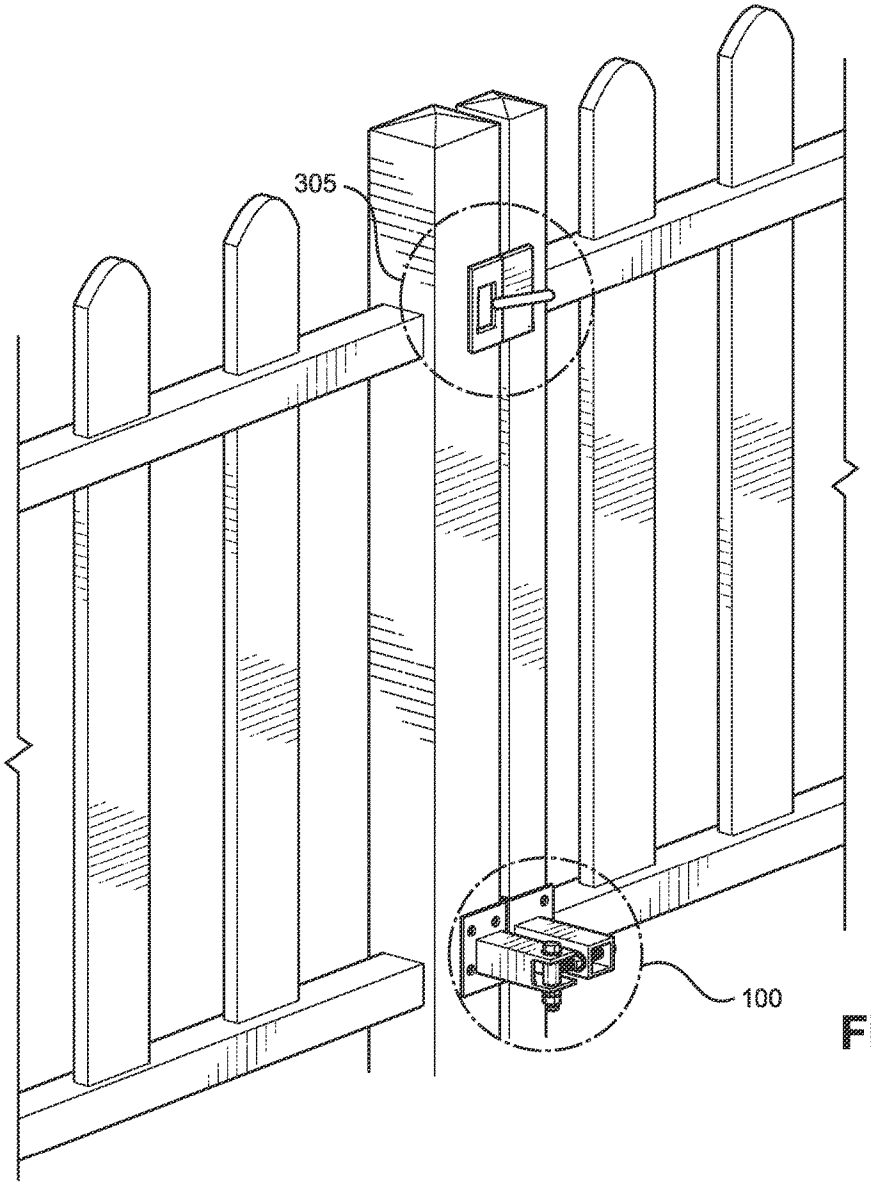
FIG. 3 is an environmental perspective view of the improved gate hinge illustrated in FIG. 1.

FIG. 3 demonstrates the placement of the hinge 100 with respect to a fence post 201 and gate 202 with the gate 202 in a closed position. As indicated, the hinge 100 may be placed at an inside lower portion of a post 201 and gate 202 junction.

Figure 4:
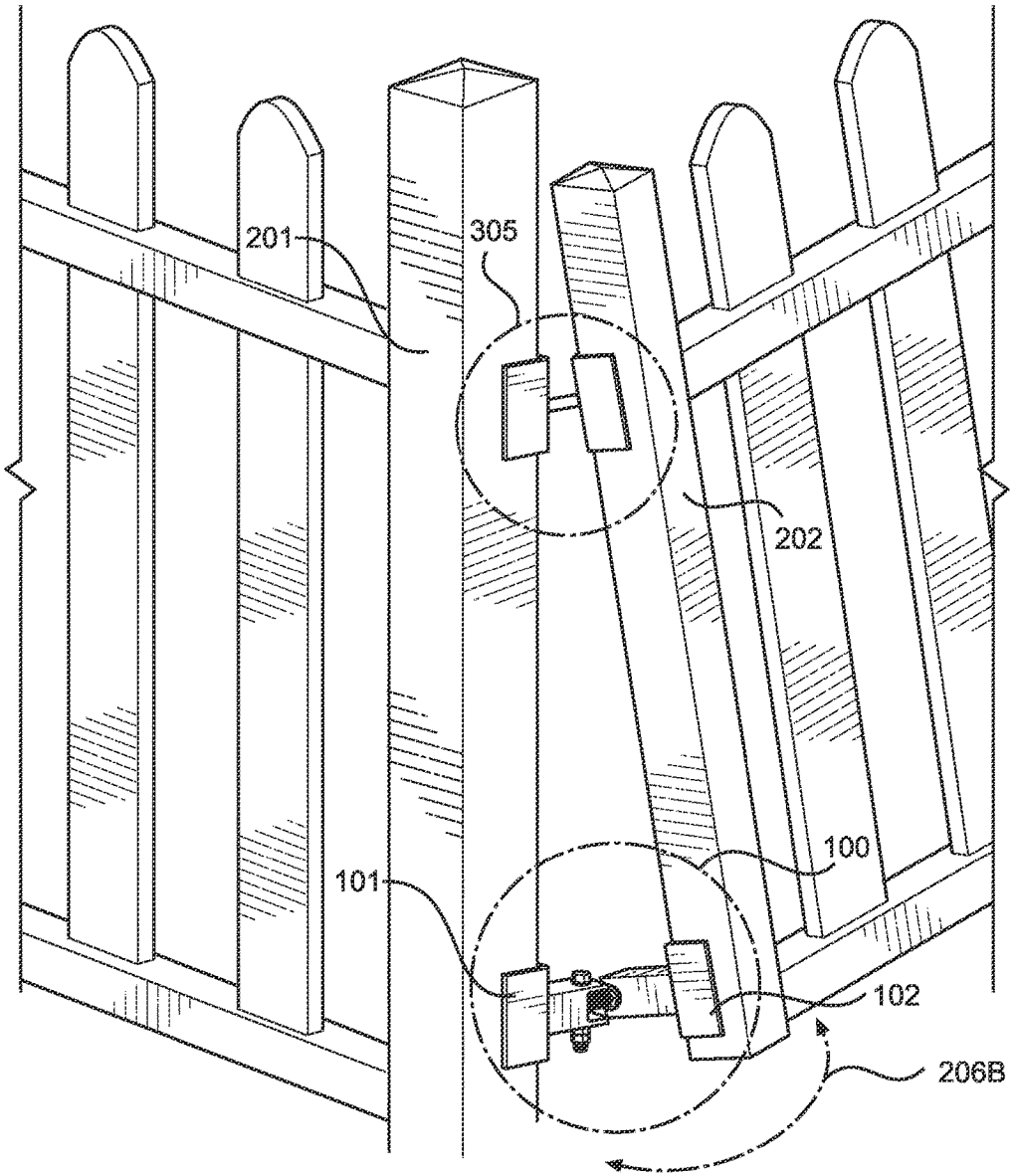
FIG. 4 is an environmental perspective view of the improved gate hinge illustrated in FIG. 1.

FIG. 4 demonstrates the placement of the hinge 100 as viewed from outside of the fence post 201 and gate 202 with the gate 202 in an opened position. As indicated, the hinge 100 may be placed at a lower portion of a post 201 and gate 202 junction and used in combination with a standard gate hinge 305.

The standard gate hinge 305 may be placed at an upper portion of a post 201 and gate 202 junction. When the gate 202 is opened, the standard gate hinge 305 may extend the gate 202 to a nominal distance from the post 201. However, the improved gate hinge 100, and more specifically the post assembly 101 may extend the lower portion of the gate 202 to a greater distance from the post 101 than the standard gate hinge 305. This extended distance from the post 201 may create an elevated angle for the gate 202 with respect to the gate 202 angle in a closed position. This elevated angle may allow for the gate 202 to open and ascend in the direction of elevated ground without being obstructed by the elevated ground. Furthermore, because the gate 202 is elevated in the open position, gravity will bias the gate 202 to a closed position when opened. Therefore, when released from an open position angled other than perpendicular to the post 201, gravity causes the gate 202 to self-close along its swing motion 206*b*. This self-closing feature may alleviate the need for a spring within the hinge 100 to close the gate.

Figure 5:
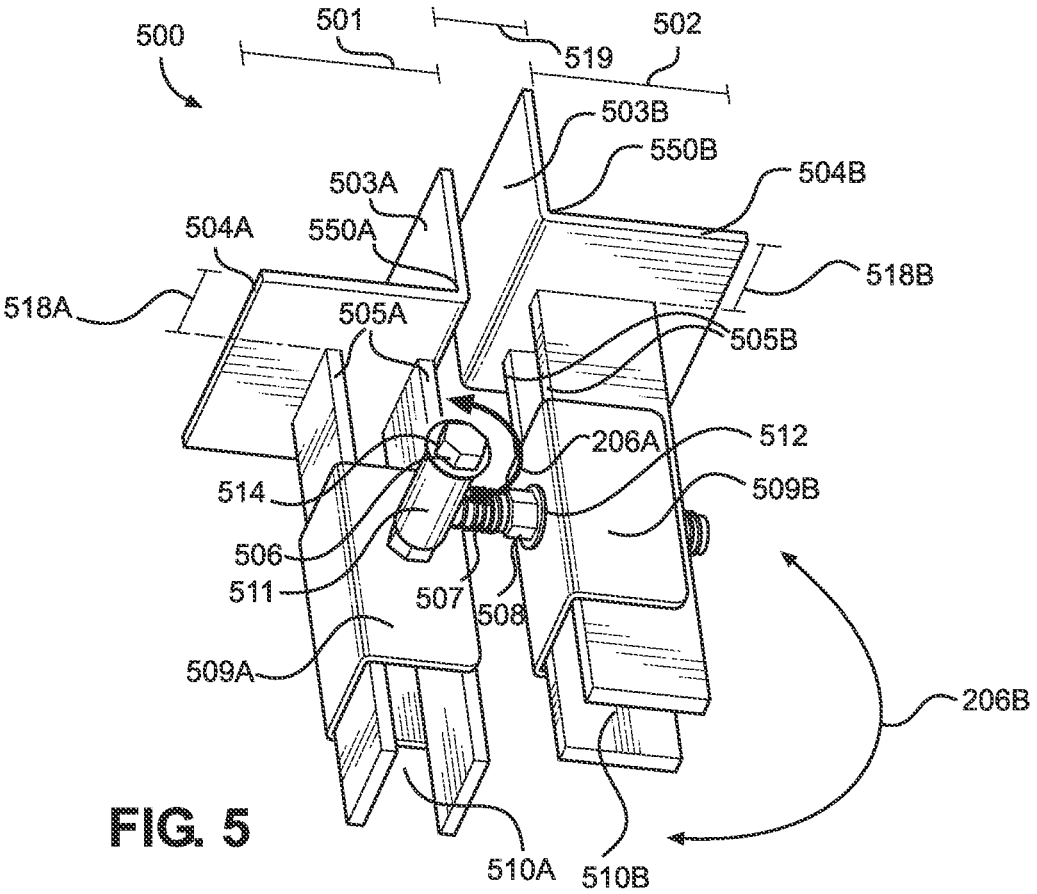
FIG. 5 is a top perspective view of an improved gate hinge according to another embodiment of the invention.

FIG. 5 demonstrates another embodiment of the hinge 500 that may include post assembly extension rails 505*a* and gate assembly extension rails 505*b*. Post assembly extension rails 505*a* may be parallel rails extending distally from the second post attachment member 504*a* on a surface facing away from a first post attachment member 503*a*. The post assembly extension rails 505*a* may create a void between them defined as a post extension track 510*a* structured to accommodate a swing axis bolt 506 to pass therebetween. When viewing the hinge 500 from the front, the post assembly extension rails 505*a* may be side-by-side from left to right creating a vertical track with respect to the hinge 500. This vertical post extension track 510*a* allows the swing axis bolt 506 to descend between the post assembly extension rails 505*a* and may provide space for the swing axis bolt 506 to slide toward and away from the L-Bracket 550*a*.

Surrounding the post assembly extension rails 505*a* may be a post extension casing 509*a*. The post extension casing 509*a* may be a slidable sleeve encasing the post assembly extension rails 505*a*. In this embodiment, the swing axis bolt 506 may extend from and through an upper portion of the post extension casing 509*a*, through the post extension track 510*a*, and through a bottom portion of the post extension casing 509*a*. The post extension casing 509*a* may allow for the swing axis bolt 506 to be adjustable within the post extension track 510*a* without prolapsing once secured in place. As such, when installing the hinge 500, a user may adjust the post extension casing 509*a* and swing axis bolt 506 to a desired distance away from the L-Bracket 550*a*.

Additionally, in this embodiment, the T-Joint 511 may be located atop the post extension casing 509*a*. As a result, a connecting bolt 507 attaching the post assembly 501 to the gate assembly 502 may be positioned on an upper portion of the post assembly 501 overtop the post assembly extension rails 505*a*. Therefore, in this embodiment the gate assembly 502, which is connected via connecting bolt 507, may be positioned higher from the ground than the post assembly 501. In combination with a post extension offset 518*a* and a gate extension offset 518*b*, the positioning of the T-Joint 511 may allow for the gate assembly extension rails 505*b* to swing overtop or underneath the post assembly extension rails 505*a* depending on their respective arrangement.

The positioning of the post assembly extension rails 505*a* on the second post attachment member 504 may cause for a post extension offset 518*a* relative to the positioning of gate assembly extension rails 505*b* located on a second gate attachment member 504*b*. This offset of the rails is what may allow the post assembly 501 and gate assembly 502 to be flush mounted onto the post 201 and gate 202 junction despite the gate extension rails 505*b* being mounted higher from the ground than the post extension rails 505*a*. In this embodiment, the offset may also allow for the gate assembly extension rails 505*b* to swing overtop the post assembly extension rails 505*a* when the gate 202 opens along its gate swing motion 206*b*.

The gate assembly extension rails 505*b* may be parallel rails extending distally from the second gate attachment member 504*b* on a surface facing away from a first gate attachment member 503*b*. The gate assembly extension rails 505*b* may create a void between them defined as a gate extension track 510*b* structured to accommodate a connecting bolt 507 to slidably pass therebetween. When viewing the hinge 500 from the front, the gate assembly extension rails 505*b* may be parallel stacked from top to bottom creating a horizontal track. This may orient the gate extension track 510*b* to open in the direction facing the post assembly 501. This horizontal gate extension track 510*b* is what allows the connecting bolt 507 to fit between the gate assembly extension rails 505*b* and slide toward and away from the L-Bracket 550*b*.

Surrounding the gate assembly extension rails 505*b* may be a gate extension casing 509*b*. The gate extension casing 509*b* may be a slidable sleeve that surrounds the gate assembly extension rails 505*b*. In this embodiment, the connecting bolt 507 may extend from and through a side portion of the gate extension casing 509*b*, through the gate extension track 510*b*, and through an opposing side portion of the gate extension casing 509*b*. The gate extension casing 509*b* may allow for the connecting bolt 507 to be adjustable within the gate extension track 510*b* without prolapsing once secured in place. As such, when installing the hinge 500, a user may adjust the gate extension casing 509*b* and connecting bolt 507 to a desired distance away from the L-Brackets 550*a*, 550*b*.

By adjusting the connecting bolt 507 and the swing axis bolt 506 away from the L-Brackets 550*a*, 550*b* along their respective extension tracks 510*a*, 510*b*, a user installing the hinge 500 effectively distances the gate assembly 502 past that of the standard gate hinge 305 to create the desired elevated angle of the gate 202. The further away from the L-Brackets 550*a*, 550*b* the more elevated the angle created.

Figure 6:
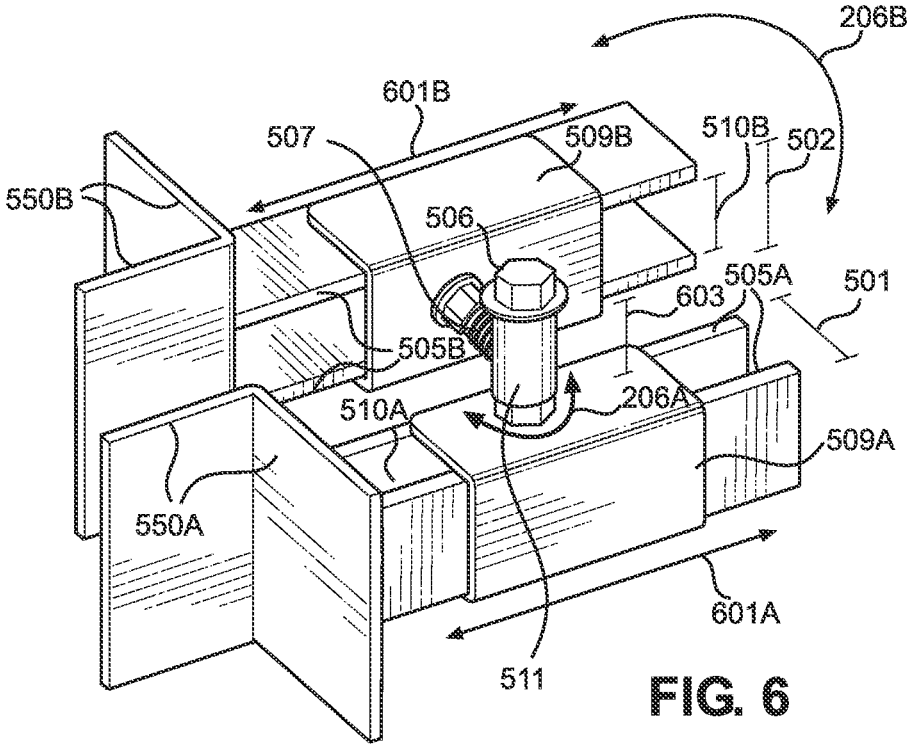
FIG. 6 is a side perspective view of the improved gate hinge illustrated in FIG. 5.

FIG. 6 shows the hinge 500 from a side view, which emphasizes a height offset 603 created between the gate assembly extension rails 505*b* and the post assembly extension rails 505*a*. In this embodiment, the T-Joint 511 sits within that height offset 603. The T-Joint 511 may swing along the swing axis motion 206*a*, which in turn may swing the gate assembly 502 and gate 202 along the gate swing motion 206*b* path. This figure also emphasizes the slidable post casing motion 601*a* and the slidable gate casing motion 601*b* along their respective extension rails 505*a*, 505*b*. Furthermore, the horizontal orientation of the gate extension track 510*b* and the vertical orientation of the post extension track 510*a* are easily viewed from this vantage point.

Figure 7A:
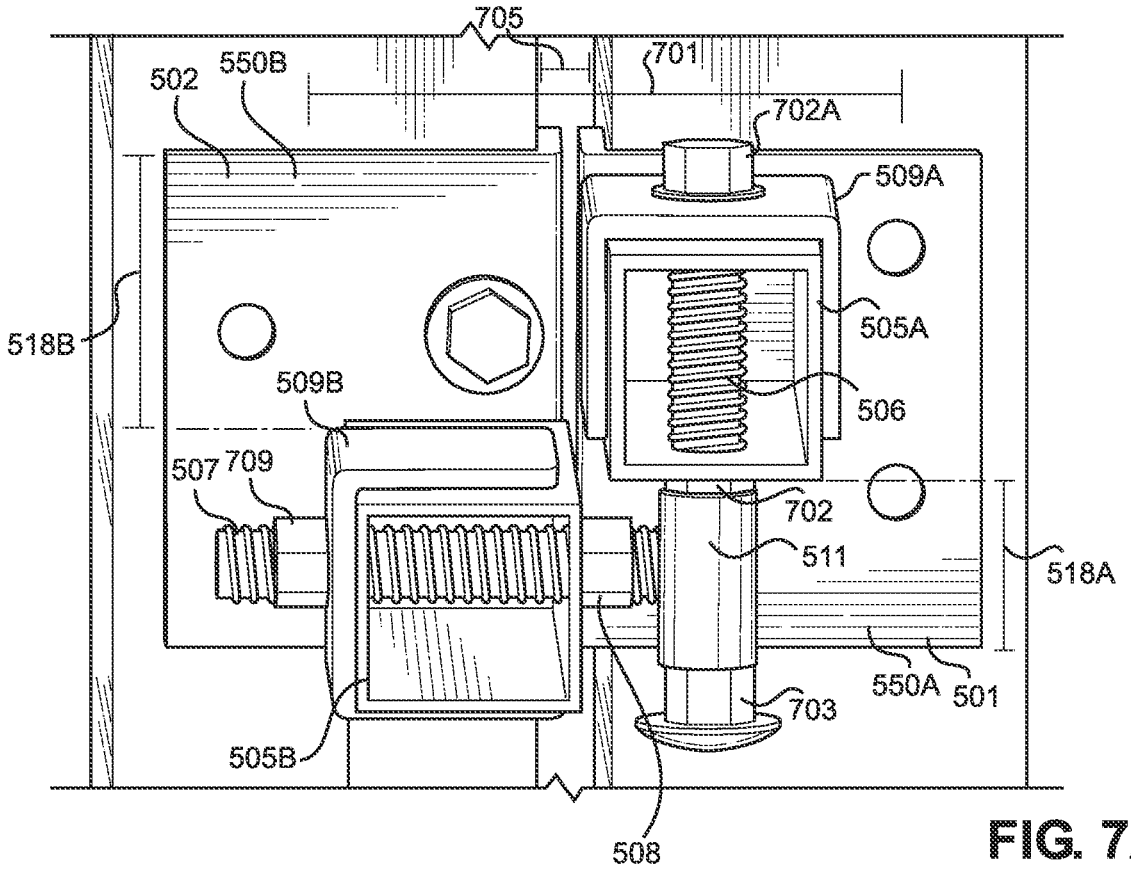
FIG. 7*a* is a front perspective view of another embodiment of the improved gate hinge.
Figure 7B:
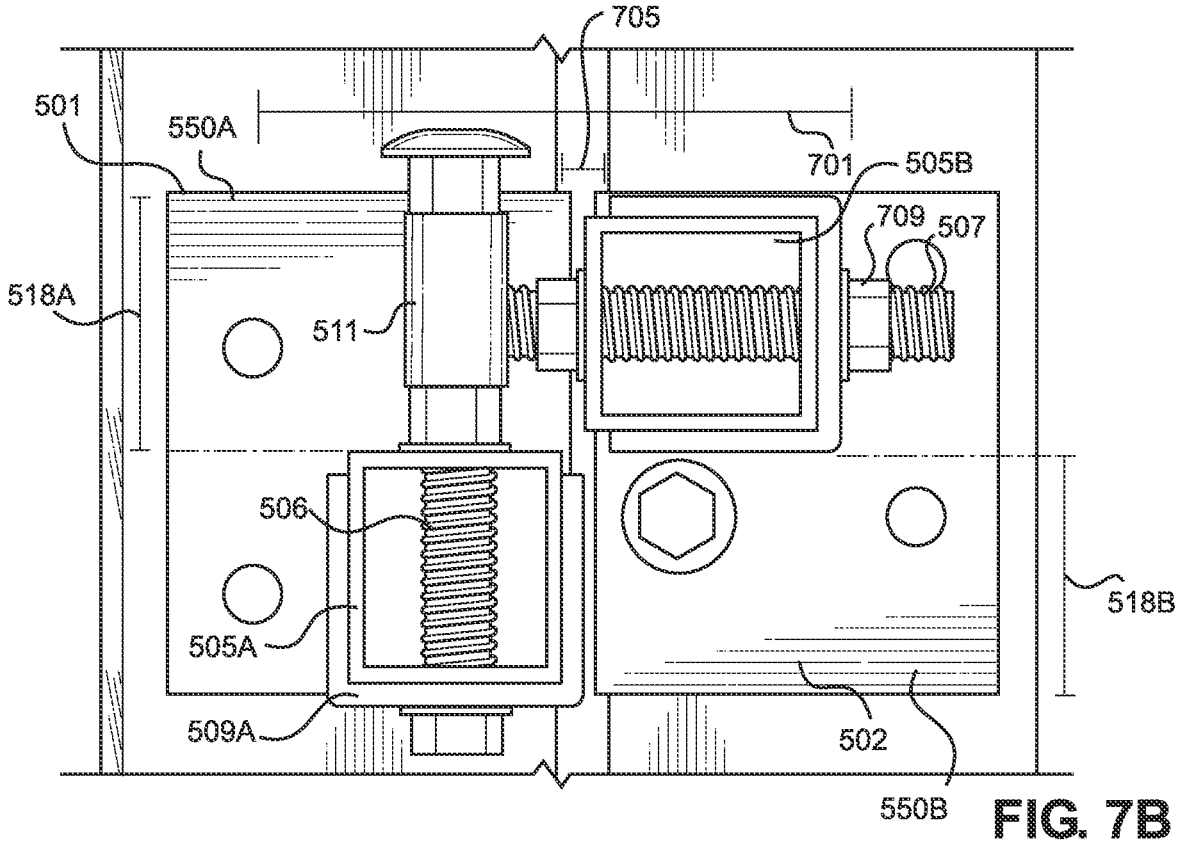
FIG. 7*b* is an inverted view of the improved gate hinge illustrated in FIG. 7*a*.

FIGS. 7*a* and 7*b* are front perspective views of the hinge 500. However, FIG. 7*b* is the inverse of 7*a*. This demonstrates that the orientation of the T-Joint 511, the respective height offsets 518*a*, 518*b*, and general positioning of the post assembly 501 and gate assembly 502 are dependent on how a user orients and installs them at the post 201 and gate 202 junction. FIG. 7*a* may swing the gate assembly extension rails 505*b* overtop the post assembly extension rails 505*a*. However, FIG. 7*b* may swing the gate assembly extension rails 505*a* underneath the post assembly extension rails 505*a*. Both orientations are contemplated to be within the scope of this application.

For the sake of clarity, the FIG. 7*a* orientation will be described hereinafter. As shown in FIG. 7*a*, the gate extension rails 505*b* are attached at a lower portion of the second gate attachment member 504*b* creating a gate extension offset 518*b*. Likewise, the post extension rails 505*a* are attached at an upper portion of the second post attachment member 504*a* creating a post extension offset 518*a*. These respective offsets 518*a*, 518*b* are what allow for the post assembly 501 and gate assembly 502 to be flush mounted 701 onto the post 201 and gate 202 junction despite the gate extension rails 505*b* being mounted lower to the ground than the post extension rails 505*a*. In this embodiment, the offsets 518*a*, 518*b* may also allow for the gate assembly extension rails 505*b* to swing underneath the post assembly extension rails 505*a* when the gate 202 opens along its gate swing motion 206*b*.

In this orientation, the T-Joint 511 may fit within the post extension offset 518*a* below the post assembly extension rails 505*a*. Furthermore, the T-Joint may be positioned between a swing access bolt bottom member 703 and a securing nut 702. The securing nut 702 may be positioned below the post extension rails 505*a* and its enveloping post extension casing 509*a* to assist with securing the swing axis bolt 506 to a desired distance from the L-Bracket 550*a*. A second securing nut 702*a* may be positioned atop the post extension rails 505*a* and its enveloping post extension casing 509*b* to further assist with securing the swing axis bolt 506 to a desired distance from the L-Bracket 550*a*.

FIG. 7*a* also shows the first distancing nut 508 and second distancing nut 709. Positioned on either side of the gate extension rails 505*b* and its enveloping gate extension casing 509*b*, these distancing nuts 508, 709 may assist with securing the connecting bolt 507 to a desired distance from the L-Bracket 550*b*. Furthermore, the first distancing nut 508 and the second distancing nut 709 may be adjusted along the connecting bolt 507 to increase or decrease a connection gap 705 between the gate assembly 502 and the post assembly 501. In this embodiment, the gate assembly 502 and post assembly 501 are adjacent without a connection gap 705 between them.

Figure 8B:
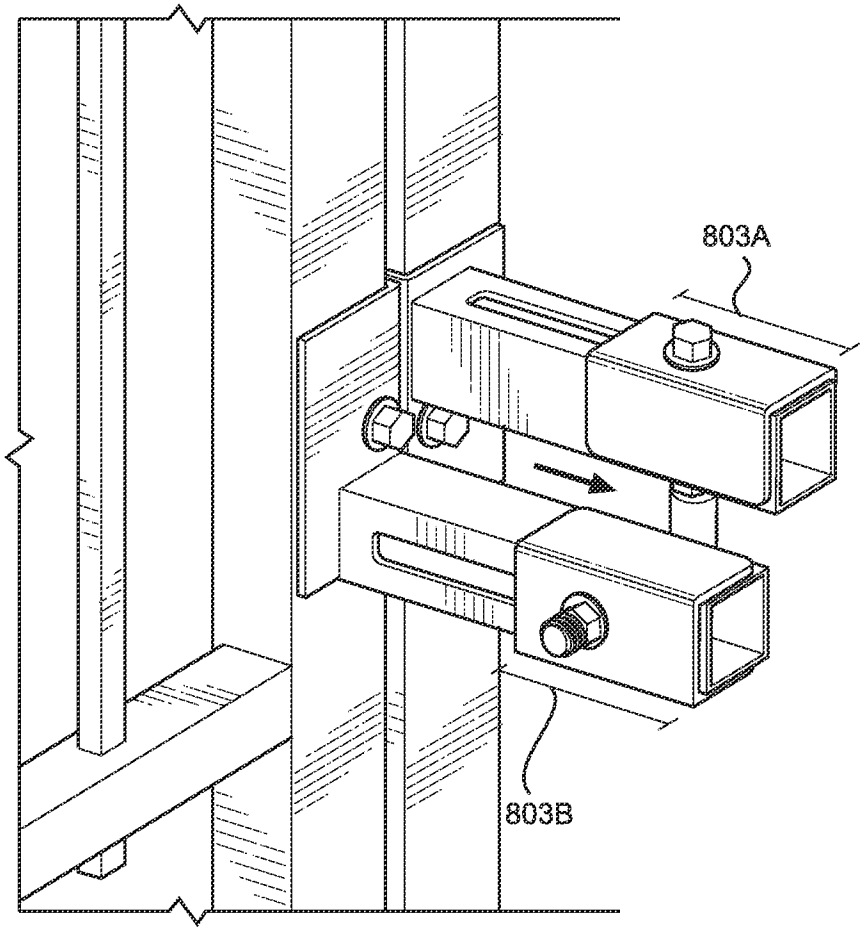
FIG. 8*b* is a side perspective view of the improved gate hinge illustrated in FIG. 7*a* in a second position.
Figure 8A:
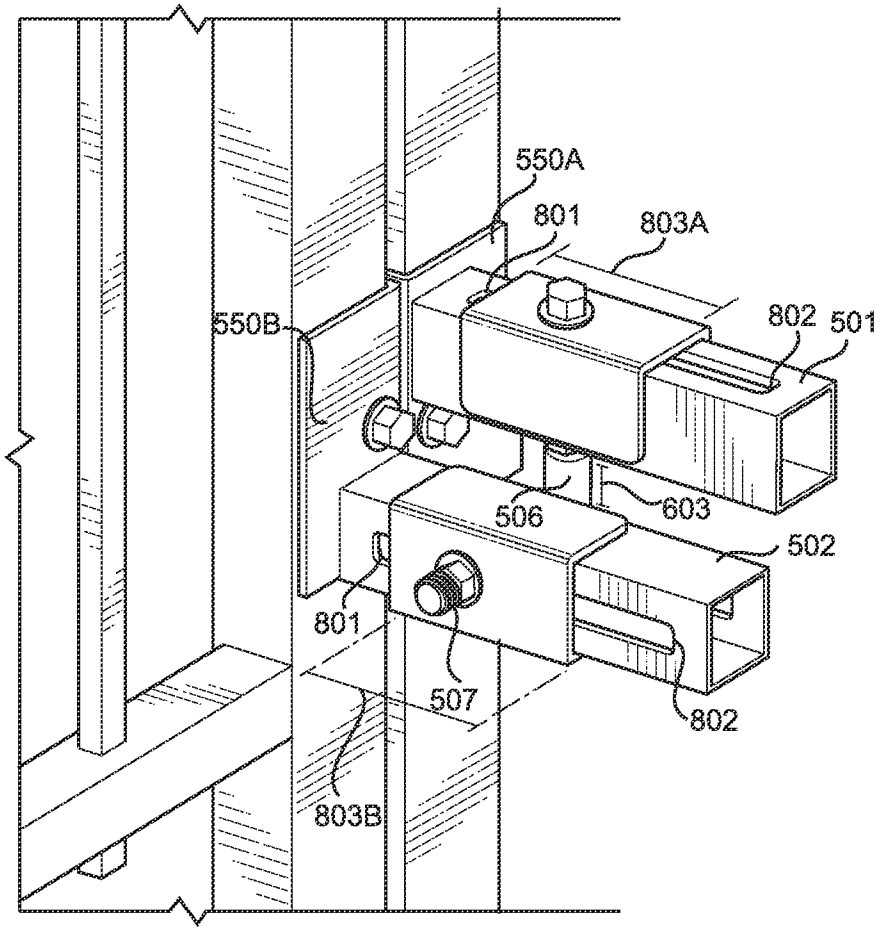
FIG. 8*a* is an environmental side perspective view of the improved gate hinge illustrated in FIG. 7*a* in a first position.

FIG. 8*a* is a side perspective view of the hinge 500 demonstrating the post extension track 510*a* and gate extension track 510*b* including an extension track first end 801 and an extension track second end 802.

The post assembly 501 extension track first and second ends 801, 802 may act as stoppers preventing the swing axis bolt 506 and the post extension casing 509*a* from either sliding off of the post assembly extension rails 505*a* or being distanced too close to the L-Bracket 550*a*. In some embodiments, the distance between the extension track first end 801 and the L-Bracket 550*a* may be the length of a standard gate hinge 305. This may indicate to an installer that positioning the swing axis bolt 506 and post extension casing 509*a* at the first end may prevent the gate assembly extension rails 505*b* from extending to create an elevated gate angle. Any other positioning along the post extension track 510*a* would assist with creating an elevated angle.

Likewise, the gate assembly 502 extension track first and second ends 801, 802 may act as stoppers preventing the connecting bolt 507 and the gate extension casing 509*b* from either sliding off of the gate assembly extension rails 505*b* or being distanced too close to the L-Bracket 550*b*. In some embodiments, the distance between the extension track first end 801 and the L-Bracket 550*b* may be the length of a standard gate hinge 305. This may indicate to an installer that positioning the connecting bolt 507 and gate extension casing 509*b* at the first end may not create an elevated gate angle. Any other positioning along the gate extension track 510*b* would create an elevated angle.

FIG. 8*a* illustrates the post extension casing 509*a* and the gate extension casing 509*b* in a first position 803*a*, 803*b* along their respective post assembly extension rails 505*a* and gate assembly extension rails 505*b*. Likewise, the respective swing axis bolt 506 and connecting bolt 507 are in a first position 803*a*, 803*b* at a selected distance from the L-Brackets 550*a*, 550*b*.

FIG. 8*b* illustrates the post extension casing 509*a* and the gate extension casing 509*b* in a second position 803*a*, 803*b* along their respective post assembly extension rails 505*a* and gate assembly extension rails 505*b*. Likewise, the respective swing axis bolt 506 and connecting bolt 507 are in a second position 903*a*, 903*b* at a selected distance from the L-Brackets 550*a*, 550*b*.

In the second position 903*a*, 903*b* the connecting bolt 507 and the swing axis bolt 506 are positioned away from the L-Brackets 550*a*, 550*b* along their respective extension tracks 510*a*, 510*b* past that of the standard gate hinge 305 to create the desired elevated angle of the gate 202. The further away from the L-Bracket 550*a* they are positioned, the more elevated the gate angle created.

Figure 9A:
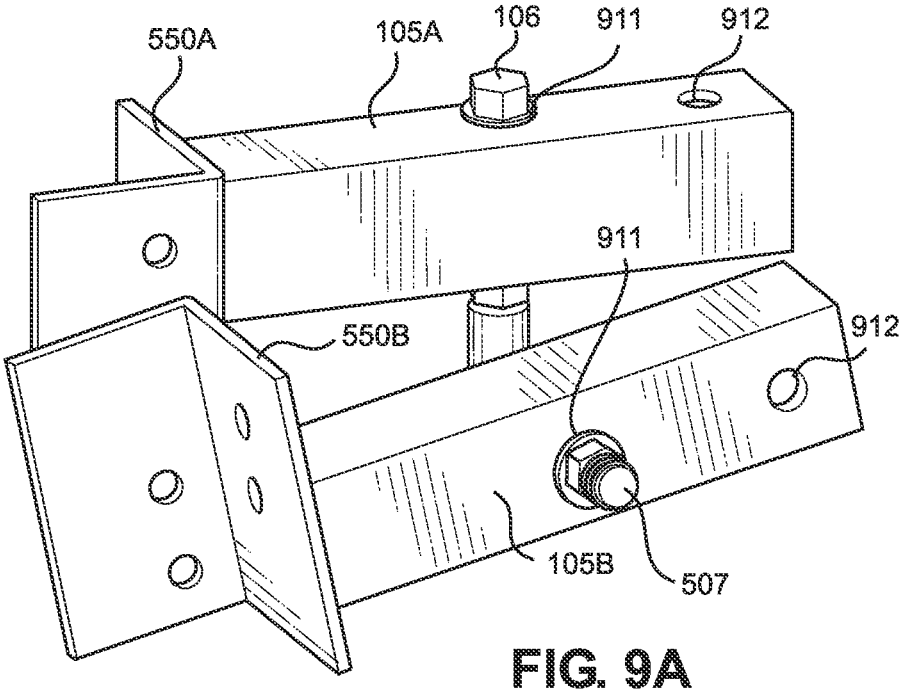
FIG. 9*a* is a side perspective view of an embodiment of the improved gate hinge illustrated in a first position.
Figure 9B:
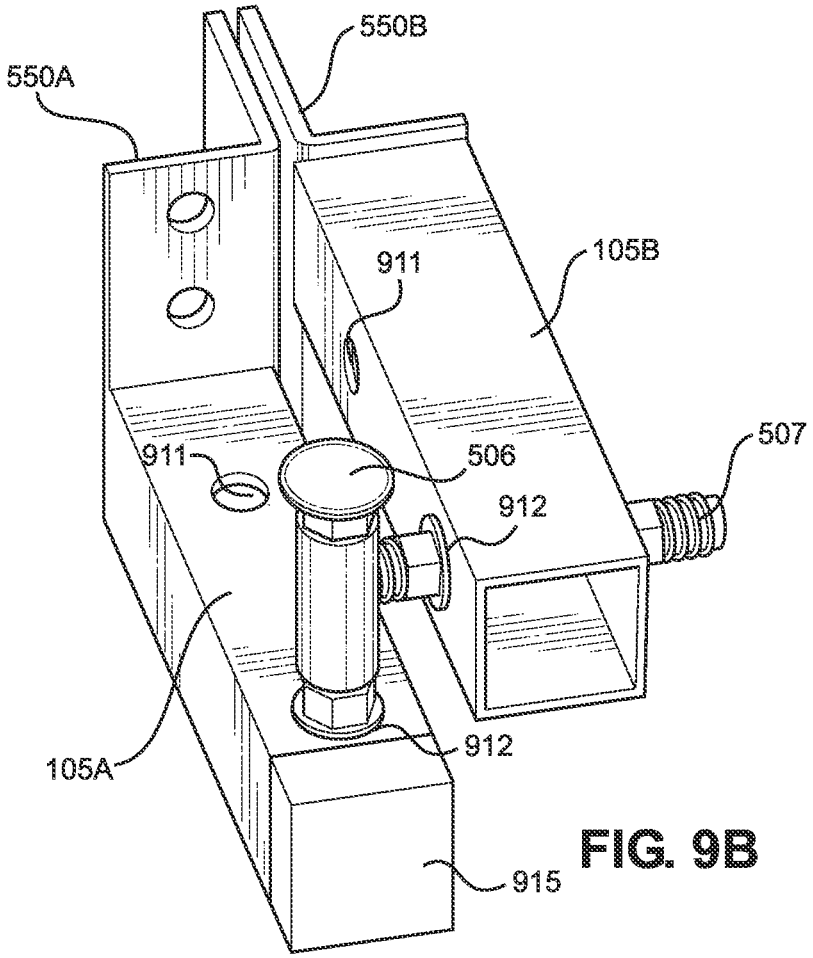
FIG. 9*b* is a side perspective view of an embodiment of the improved gate hinge illustrated in a second position.

FIG. 9*a* and FIG. 9*b* illustrate that the different embodiments of the improved gate hinge 100 may include a plurality of positioning holes structured to adjust the distal extension of the swing axis bolt 506 and the connecting bolt 507. A plurality of positioning holes may be located on the top and bottom of the post assembly extension 105*a* and a plurality of positioning holes may be located on a first side and second side of the gate assembly extension 105*b*. FIG. 9*a* shows the swing axis bolt 506 and the connecting bolt 507 located in a first position 911. FIG. 9*b* shows the swing axis bolt 506 and the connecting bolt 507 located in a second position 912. In the first position 911 the swing axis bolt 506 and the connecting bolt 507 are closer to the L-Brackets 550*a*, 550*b* than in the second position 912. As a result, the extended distance between the L-Brackets 550*a*, 550*b*, and the swing axis bolt 506 and connecting bolt 507 in the first position 911 is shorter than in the second position 912. As will be shown hereinafter, the greater the extended distance the greater the elevated angle created for the bottom of the gate 202. Therefore, the plurality of positioning holes may allow for a user to adjust the opening incline angle of the gate 201 by adjusting the respective swing axis bolt 506 and connecting bolt 507 in either the first position 911 or the second position 912. In some embodiments there may be more or less positions and therefore more or less positioning holes depending on need, preference, and circumstance.

Figure 10:
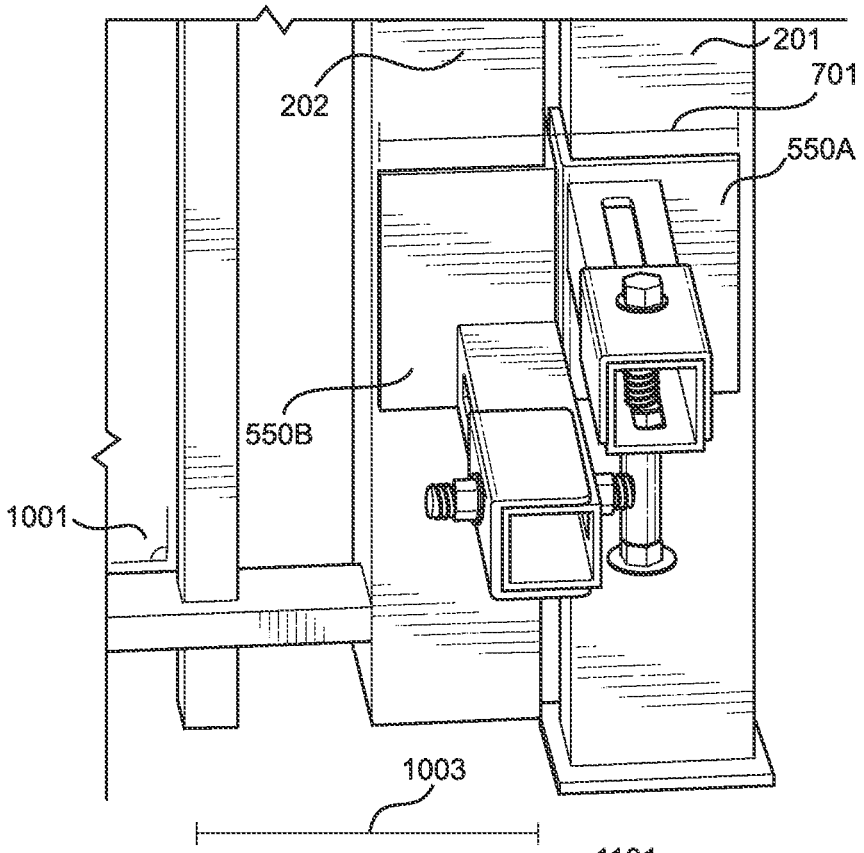
FIG. 10 is a front perspective view of the improved gate hinge illustrated in FIG. 7*a* demonstrating a closed gate.

FIG. 10 shows an environmental view of the gate assembly 202 and the post assembly 201 with their respective L-Brackets 550*a*, 550*b* flush mounted onto their respective gate 202 and post 202. In this embodiment the gate assembly extension rails 505*b* are positioned lower to the ground than the post assembly extension rails 505*a*. Furthermore, since the gate 202 is in the closed position, the gate 202 creates a 90-degree angle with the post 1001 and forms a parallel gate angle 1003 with even ground.

Figure 11:
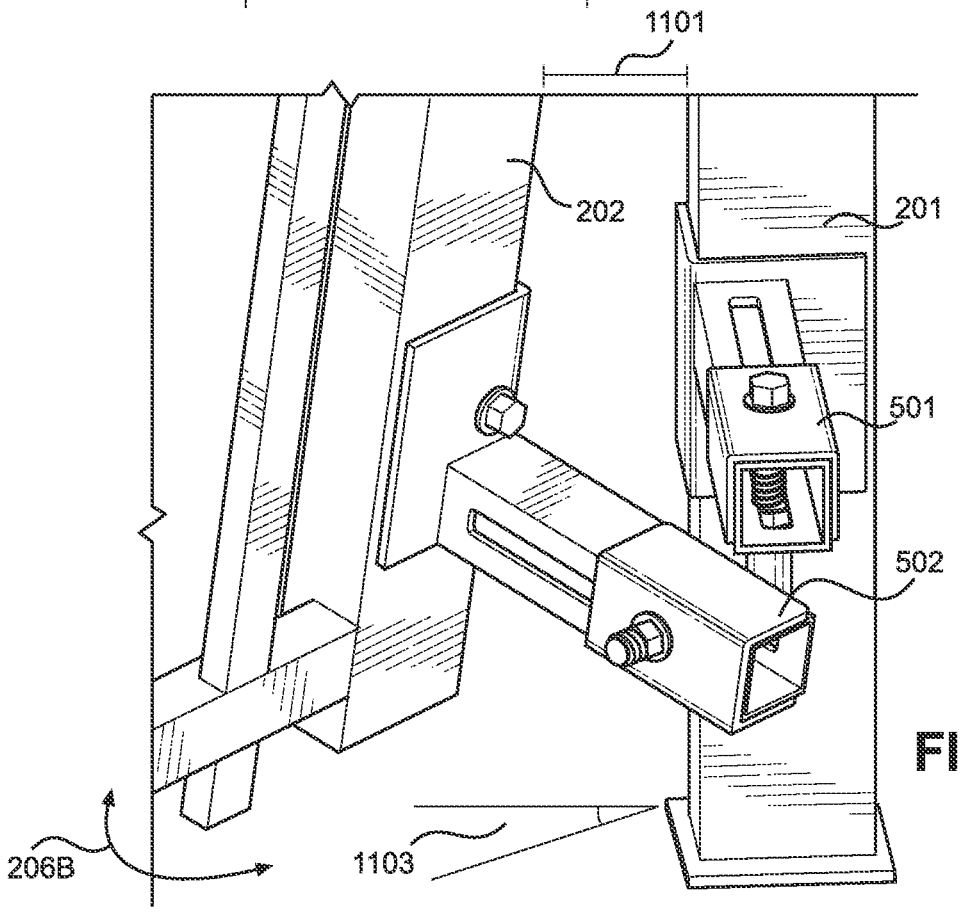
FIG. 11 is a front perspective view of the improved gate hinge illustrated in FIG. 7*a* demonstrating a partially opened gate.

FIG. 11 shows an environmental view of a partially opened gate 1101. The gate swing motion 206*b* is bringing the gate assembly extension rails 505*b* underneath the post assembly extension rails 505*a* and the extension of the hinge 500 is beginning to create an elevated gate angle 1103.

Figure 12:
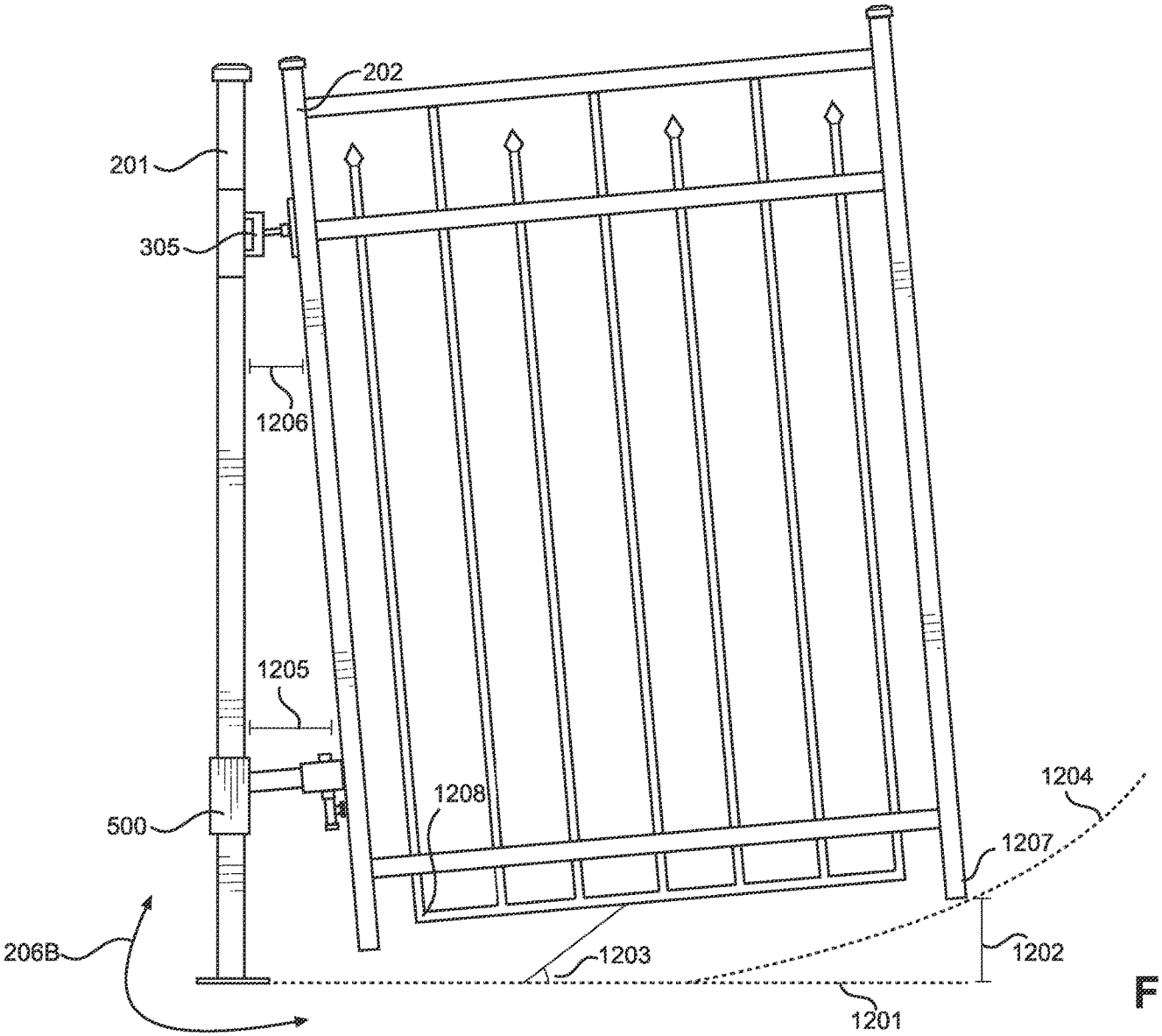
FIG. 12 is a side perspective view of the improved gate hinge illustrated in FIG. 7*a* demonstrating the created angle of an opened gate.

FIG. 12 demonstrates the gate 202 in a fully opened position. A standard gate hinge distance 1206 is easily compared against the improved hinge distance 1205 showing the improved hinge 500 extending further from the post 201. Also shown is the elevated gate angle 1203 as compared to level ground 1201. This creates a greater distance 1202 between the gate second end 1207 and level ground 1201 compared to a gate first end 1208 and level ground. The elevated gate angle 1203 and greater distance 1202 may allow for the bottom of the gate 202 to clear sloped ground 1204 without being obstructed by the sloped ground 1204. Hence, the post assembly extension 105*a* is structured to distally extend a bottom portion of a gate 202 attached to the gate assembly 120 relative to a top portion of the gate 202. The distal extension is structured to create an elevated gate angle 1203 between the gate bottom and ground when the improved gate hinge 100 is actuated.

That which is claimed is:

1. An improved gate hinge comprising
a post assembly comprising
an L-Bracket;
a post assembly extension; and
a swing axis bolt with a T-Joint;
a connecting bolt, and
a gate assembly comprising
an L-Bracket; and
a gate assembly extension;
wherein the swing axis bolt is oriented vertically through a top and bottom of the post assembly extension;
wherein the connecting bolt is oriented horizontally through a first side and a second side of the gate assembly extension;
wherein the connecting bolt is configured to connect the gate assembly to the post assembly at the T-Joint; and
wherein the gate assembly extension is configured to rotate underneath the post assembly extension when the improved gate hinge is actuated.

2. The improved gate hinge of claim 1 wherein the post assembly extension is configured to distally extend a bottom portion of a gate attached to the gate assembly relative to a top portion of the gate; and wherein the distal extension is configured to create an elevated angle between the gate bottom and ground when the improved gate hinge is actuated.

3. The improved gate hinge of claim 1 further including a first distancing nut on a first side of the gate assembly extension and a second distancing nut on a second side of the gate assembly extension configured to be adjustable along the connecting bolt to increase or decrease a connection gap between the gate assembly and the post assembly.

4. The improved gate hinge of claim 1 wherein the swing axis bolt is positioned on the post assembly extension proximate an end distal the L-Bracket.

5. The improved gate hinge of claim 1 wherein the post assembly and the gate assembly are configured to attach to a bottom portion of a fence post and gate respectively.

6. The improved gate hinge of claim 1 wherein the gate assembly is rotated via the T-Joint on the swing axis bolt.

7. The improved gate hinge of claim 1 wherein the post assembly extension and the gate assembly extension include a plurality of positioning holes configured to adjust the distal extension of the swing axis bolt and the connecting bolt; and wherein the plurality of positioning holes on the post assembly extension is located on the top and bottom of the post assembly extension and the plurality of positioning holes on the gate assembly extension is located on a first side and second side of the gate assembly extension.

8. An improved gate hinge comprising
a post assembly comprising
an L-Bracket;
a post assembly extension; and
a swing axis bolt with a T-Joint;
a connecting bolt, and
a gate assembly comprising
an L-Bracket; and
a gate assembly extension;
wherein the swing axis bolt is oriented vertically on the post assembly extension;
wherein the connecting bolt is oriented horizontally on the gate assembly extension;
wherein the connecting bolt is configured to connect the gate assembly to the post assembly at the T-Joint;
wherein the gate assembly extension is configured to rotate via the T-Joint on the swing axis bolt;
wherein the gate assembly extension is configured to rotate one of above and below the post assembly extension when the improved gate hinge is actuated;
wherein the post assembly extension is configured to distally extend a bottom portion of a gate attached to the gate assembly relative to a top portion of the gate; and
wherein the distal extension of the gate is configured to create an elevated angle between the gate bottom and ground when the improved gate hinge is actuated.

9. The improved gate hinge of claim 8 wherein the post assembly extension and the gate assembly extension are comprised of extension rails forming a post extension track and gate extension track between their respective rails.

10. The improved gate hinge of claim 9 wherein at least a portion of the swing axis bolt is positioned within the post assembly extension track and at least a portion of the connecting bolt is positioned within the gate assembly extension track.

11. The improved gate hinge of claim 9 wherein the post assembly extension rails are positioned on the post assembly L-Bracket in a non-linear configuration with the positioning of the gate assembly extension rails on the gate assembly L-Bracket to create an asymmetric offset; and wherein the asymmetric offset is configured to create a flush mount for the post assembly and gate assembly.

12. The improved gate hinge of claim 11 wherein the T-Joint is positioned within the asymmetric offset between the post assembly extension rails and the gate assembly extension rails.

13. The improved gate hinge of claim 9 wherein the post assembly extension rails are parallel stacked to create a horizontal track therebetween; and wherein the gate assembly extension rails are side-by-side from left to right to create a vertical track therebetween.

14. The improved gate hinge of claim 8 further including a post extension casing and a gate extension casing configured as slidable sleeves.

15. The improved gate hinge of claim 14 wherein the post extension casing is configured to adjust the distance between the post assembly L-Bracket and the swing axis bolt and the gate extension casing is configured to adjust the distance between the gate assembly L-Bracket and the connecting bolt.

16. The improved gate hinge of claim 14 wherein the T-Joint is located atop the post extension casing and the connecting bolt is connected to a side portion of the gate extension casing.

17. The improved gate hinge of claim 14 wherein the post extension casing and the gate extension casing are slidable to adjust the distal extension; and wherein an increased distal extension is configured to create an increased elevated angle for a gate bottom.

18. The improved gate hinge of claim 8 wherein the post assembly extension and the gate assembly extension include a plurality of positioning holes configured to adjust the distal extension of the swing axis bolt and the connecting bolt.

19. The improved gate hinge of claim 18 wherein a first plurality of positioning holes is located on the top and bottom of the post assembly extension and a second plurality of positioning holes is located on a first side and second side of the gate assembly.

20. An improved gate hinge comprising
a post assembly comprising
an L-Bracket;
a post assembly extension; and
a swing axis bolt with a T-Joint;
a connecting bolt, and
a gate assembly comprising
an L-Bracket; and
a gate assembly extension;
wherein the swing axis bolt is oriented vertically on the post assembly extension;
wherein the connecting bolt is oriented horizontally on the gate assembly extension;
wherein the connecting bolt is configured to connect the gate assembly to the post assembly at the T-Joint;
wherein the gate assembly extension is configured to rotate via the T-Joint on the swing axis bolt;
wherein the post assembly extension and the gate assembly extension include at least one of:
a. a slidable extension casings and extension tracks; and
b. a plurality of positioning holes;
configured to adjust the distal extension of the swing axis bolt and the connecting bolt;
wherein the post assembly and the gate assembly are configured to attach to a bottom portion of a fence post and gate respectively;
wherein the post assembly extension is configured to distally extend a bottom portion of a gate attached to the gate assembly relative to a top portion of the gate; and
wherein the distal extension is configured to create an elevated angle between the gate bottom and ground when the improved gate hinge is actuated.

* * * * *